US007530384B2

(12) United States Patent
Nakayama et al.

(10) Patent No.: US 7,530,384 B2
(45) Date of Patent: May 12, 2009

(54) DUAL ROLL CASTING MACHINE

(75) Inventors: Isamu Nakayama, Yokohama (JP); Katsumi Nakayama, Yokohama (JP)

(73) Assignee: Ishikawajima-Harima Heavy Industries Co., Ltd., Tokyo (JP)

( * ) Notice: Subject to any disclaimer, the term of this patent is extended or adjusted under 35 U.S.C. 154(b) by 687 days.

(21) Appl. No.: 10/490,733

(22) PCT Filed: Jul. 24, 2003

(86) PCT No.: PCT/JP03/09382

§ 371 (c)(1),
(2), (4) Date: Apr. 8, 2004

(87) PCT Pub. No.: WO2004/016370

PCT Pub. Date: Feb. 26, 2004

(65) Prior Publication Data

US 2004/0244940 A1 Dec. 9, 2004

(30) Foreign Application Priority Data

Aug. 12, 2002 (JP) ..... 2002-234996

(51) Int. Cl.
*B22D 11/06* (2006.01)

(52) U.S. Cl. ..... 164/428; 164/480

(58) Field of Classification Search ..... 164/428, 164/480

See application file for complete search history.

(56) References Cited

U.S. PATENT DOCUMENTS

| | | | | |
|---|---|---|---|---|
| 3,833,050 | A | | 9/1974 | Kashuba et al. |
| 4,341,261 | A | * | 7/1982 | Thomson et al. |
| 5,660,224 | A | | 8/1997 | Usinor-Sacilor et al. |
| 6,079,479 | A | | 6/2000 | Ishikawajima-Harima et al. |
| 6,273,178 | B1 | | 8/2001 | Ishikawajima-Harima et al. |

FOREIGN PATENT DOCUMENTS

| | | | |
|---|---|---|---|
| EP | 0 352 356 | | 1/1990 |
| EP | 726 112 | | 8/1996 |
| EP | 780 177 | | 6/1997 |
| JP | 1-166864 | | 6/1989 |
| JP | 8-197200 | * | 8/1996 |
| JP | 10-29046 | | 2/1998 |
| JP | 2001 150111 | | 6/2001 |
| WO | 02/11924 | | 2/2002 |

* cited by examiner

*Primary Examiner*—Kuang Lin
(74) *Attorney, Agent, or Firm*—Oblon, Spivak, McClelland, Maier & Neustadt, P.C.

(57) ABSTRACT

A twin roll casting machine that can reduce an amount of inert gas supplied. A duct is upwardly urged by cylinders to compress resilient sealing members respectively between a flange on a casting module and an upper flange on the duct and between a lower flange on the duct and a lower surface on a peripheral edge of an upper-end opening of an enclosure to maintain air-tightness of connections between the casting module and the duct and between the duct and the enclosure. A scrap box is moved upward by jacks to make a lower edge of a partition plate of an upper sealing member on the enclosure penetrate into the sealing material stored in a groove on the scrap box to maintain air-tightness of a connection between the scrap box and the enclosure.

8 Claims, 3 Drawing Sheets

DUAL ROLL CASTING MACHINE

TECHNICAL FIELD

This invention relates to a twin roll casting machine.

BACKGROUND ART

FIG. 1 shows a conventional twin roll casting machine based on an invention disclosed in JP-8-300108A.

This twin roll casting machine comprises a casting module 3 with a pair of chilled rolls 1 adapted to continuously cast a strip 2, a pair of pinch rolls 4 for pinching the strip 2 from the chilled rolls 1 to feed the same to a succeeding process such as rolling, an enclosure 5 with an open lower end for enclosing a transfer path of the strip 2 from the casting module 3 to the pinch rolls 4, a scrap box 7 with an upper-end opening confronting the lower-end opening of the enclosure 5, said scrap box being vertically movable by jacks 6, and a sledding table 8 and a plurality of table rolls 9 arranged within the enclosure 5.

The casting module 3 has a pair of side weirs 10 abutting on one and the other ends of the chilled rolls 1, respectively, a sealing chamber 11 under the chilled rolls 1 for surrounding the transfer path of the strip 2 and sealing members 12 contiguous with an upper end of the sealing chamber 11 to abut on outer peripheries of the chilled rolls 1.

The chilled rolls 1 are horizontally arranged in parallel with each other, a nip between the rolls being adjustable to be selectively increased or decreased depending upon thickness of the strip 2 to be cast.

Rolling directions and velocities of the chilled rolls 1 are set such that the outer peripheries of the rolls are moved from above toward the nip at the same velocity.

The chilled rolls 1 are structured such that cooling water may pass through the rolls.

Molten metal is fed to a space defined by the chilled rolls 1 and the side weirs 10 to form a molten metal pool 13.

Formation of the molten metal pool 13 and rotation of the rolls 1 which are being cooled cause the metal to solidify on the outer peripheries of the chilled rolls 1 so that the strip 2 is delivered downward via the nip.

The pinch rolls 4 are arranged downstream of the chilled rolls 1 and adjacent to a succeeding process to which the strip 2 is to be delivered.

An upper end of the enclosure 5 provides a sealing chamber 14 into and from which a lower end of the sealing chamber 11 of the casting module 3 may be inserted and withdrawn.

A sealing member 15 is arranged between a vertical wall of the sealing chamber 14 and a lower vertical surface of the sealing chamber 11 of the casting module 3 and is in surface contact wholly with peripheries of these sealing chambers 11 and 14.

A downstream portion of the enclosure 5 in a direction of travel of the strip 2 is provided with sealing members 16 abutting on outer peripheries of the pinch rolls 4.

A peripheral edge of the upper-end opening of the scrap box 7 is provided with a sealing member 17 which may be in surface contact wholly with a peripheral edge of the lower-end opening of the enclosure 5 when the scrap box 7 is lifted up by the jacks 6.

This scrap box 7 is provided to withdraw any shape-defective strip 2 produced upon initial phase of a casting operation.

Inert gas (nitrogen gas) G is fed through a conduit 18 into the casting module 3, the enclosure 5 and the scrap box 7 so as to maintain interiors of the same in non-oxidative atmosphere for prevention of the hot strip 2 from oxidization.

The inert gas G is restrained from flowing outside by the sealing members 12 and 16, respectively, between the sealing chamber 11 and the chilled rolls 1 and between the enclosure 5 and the pinch rolls 4.

The sledding table 8 is adapted to take two alternative postures, one for guidance of the strip 2 from the chilled rolls 1 to the pinch rolls 4 and the other not in contact with the strip 2.

The sledding table 8 is arranged to support from below the strip 2 passing via the table rolls 9 to the pinch rolls 4.

However, in the twin roll casting machine shown in FIG. 1, atmosphere temperature in the enclosure 5 may rise under the influence of the hot molten metal pool 13, resulting in thermal deformation of the sealing chambers 11 and 14, the enclosure 5 and the scrap box 7.

This causes the sealing members 15 and 17 not to be in surface contact wholly with the outer periphery of the sealing chamber 11 and wholly with the peripheral edge of the lower-end opening of the enclosure 5, so that the inert gas G to be charged in the casting module 3, the enclosure 5 and the scrap box 7 is allowed to flow outside and ambient air flows into the enclosure 5 and the like in an amount corresponding to that of the inert gas G having flowed outside.

Therefore, the enclosure 5 must be replenished with inert gas G in an amount corresponding to that of the inert gas G having flowed outside so as to prevent the strip 2 from being oxidized.

The present invention was made in view of the above and has its object to provide a twin roll casting machine which can reduce an amount of inert gas supplied for prevention of the strip from oxidization.

SUMMARY OF THE INVENTION

In a twin roll casting machine according to the invention, the duct is urged upward by the pushing means to compress the resilient sealing members respectively between a peripheral edge of the lower-end opening of the casting module and the upper flange and between the lower flange and the lower surface on the peripheral edge of the upper-end opening of the enclosure; these resilient seals maintain air-tightness of the connections between the casting module and the duct and between the duct and the enclosure.

The resilient sealing members to be compressed may be hollow to be readily in close contact with the casting module and the enclosure, which improves the air-tightness of the connections between the casting module and the duct and between the duct and the enclosure.

The scrap box may be moved upward by the lift means so that a lower edge of the partition plate is penetrated into the sealing material stored in the groove so that the air-tightness of the connection between the scrap box and the enclosure is maintained by the lower sealing member, the sealing material and the upper sealing member.

The lower sealing member with the plural grooves and the upper sealing member with the plural partition plates may provide a multi air-tightness maintaining boundary, which improves air-tightness of the connection between the scrap box and the enclosure.

The sealing material to be stored in the groove of the lower sealing member may be powder or granule so as to reduce wear or wastage of the sealing material.

The sealing material to be stored in the groove on the lower sealing member may be liquid so as to facilitate a charging operation of the sealing material into the groove.

BEST MODE FOR CARRYING OUT THE INVENTION

An embodiment of the invention will be described in conjunction with the drawings.

Figure 1:
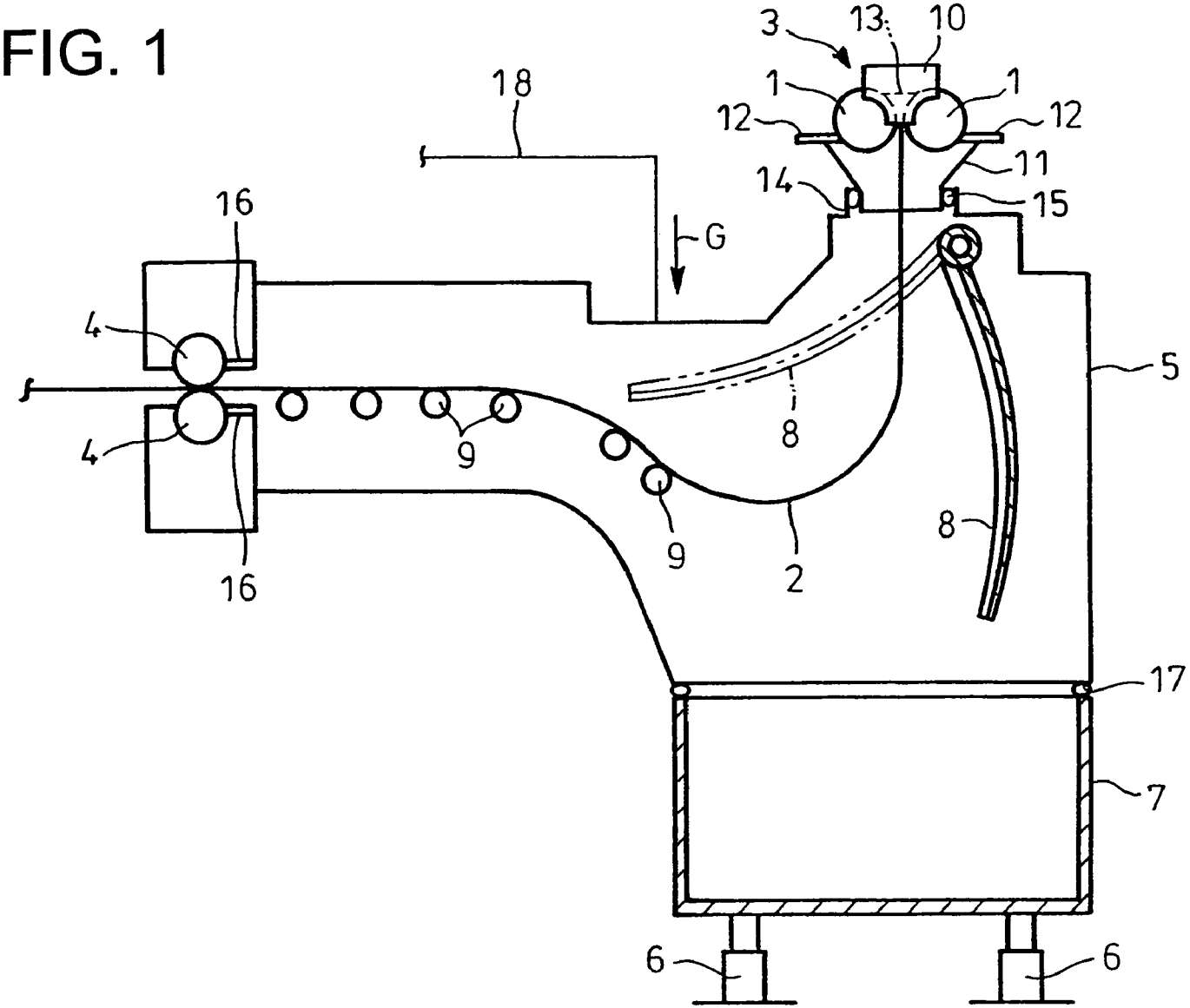
FIG. 1 is a schematic diagram showing a conventional twin roll casting machine.
Figure 2:
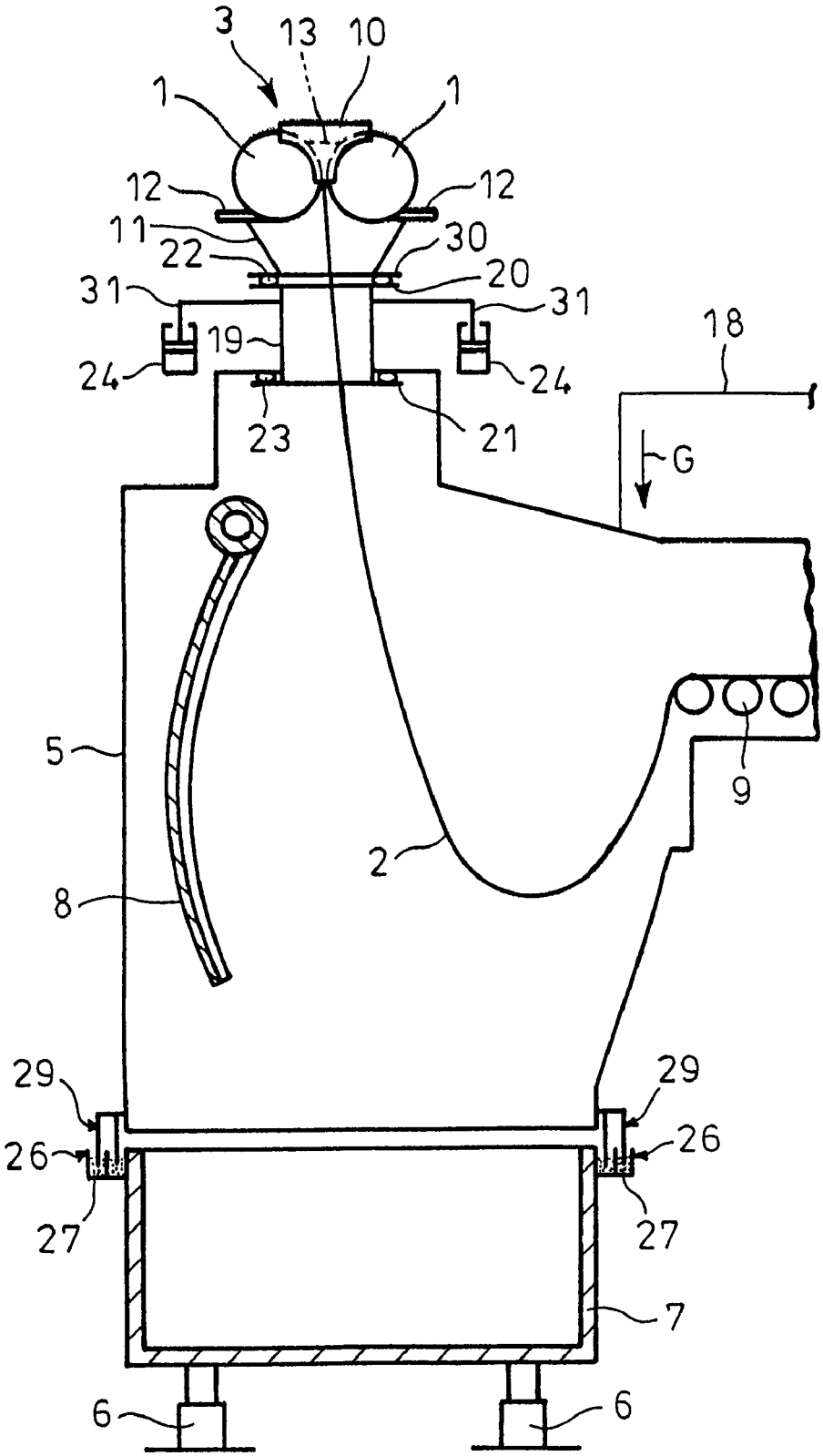
FIG. 2 is a schematic diagram of an embodiment of a twin roll casting machine according to the invention.
Figure 3:
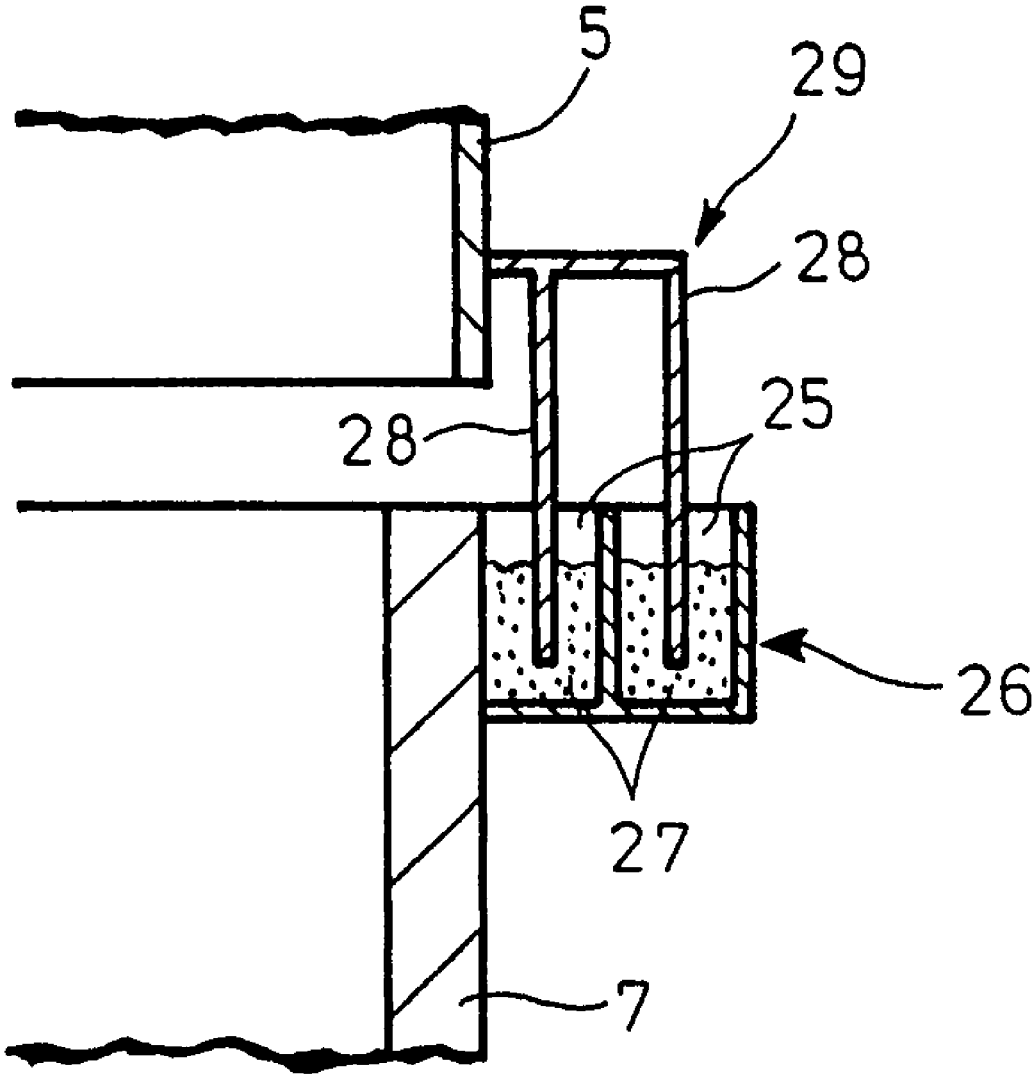
FIG. 3 is a sectional view showing a sealing structure between the enclosure and the scrap box in connection with FIG. 2.

FIGS. 2 and 3 shows an embodiment of a twin roll casting machine according to the invention in which parts same as those in FIG. 1 are represented by the same reference numerals.

This twin roll casting machine comprises a duct 19 arranged between a casting module 3 and an enclosure 5 to surround a strip 2 from chilled rolls 1, an upper flange 20 contiguous with an upper-end peripheral edge of the duct 19 to extend peripherally, a lower flange 21 contiguous with a lower-end peripheral edge of the duct to extend peripherally, resilient sealing members 22 and 23 mounted over upper surfaces of these flanges 20 and 21, cylinders 24 which urge the duct 19 upward, a lower sealing member 26 arranged over an outer periphery of a scrap box 7 and having peripherally extending grooves 25, sealing material 27 stored in grooves 25 on the lower sealing member 26 and an upper sealing member 29 arranged over an outer periphery of the enclosure 5 and having partition plates 28 adapted to be fitted in the grooves 25.

The sealing chamber 11, which constitutes the casting module 3, is provided with a flange 30 contiguous with a lower-end peripheral edge of the same to extend peripherally.

A lower portion of the duct 19 is vertically movably inserted into an opening on an upper end of the enclosure 5, and the upper flange 20 precisely confronts the flange 30 of the sealing chamber 11.

Moreover, the lower flange 21 confronts a lower surface on a peripheral edge of the upper-end opening of the enclosure 5.

The resilient sealing members 22 and 23 are made from heat-resisting material to be compressively deformable.

The upper resilient sealing member 22 is fixed to the upper flange 20 and not to the flange 30 of the sealing chamber 11 for the purpose of making the casting module 3 displaceable upon replacement of the chilled rolls 1.

The lower resilient sealing member 23 may be fixed only to the lower flange 21; alternatively, it may be fixed both to the lower flange 21 and to the enclosure 5.

These resilient sealing members 22 and 23 may be of solid or hollow endless shape to utilize resiliency of the material itself when the material is a heat-resistant high molecular compound. They may be of telescopic bellows shape when the material is metal sustainable to repeated stress in hot atmosphere.

The cylinders 24 are arranged outside of the duct 19 such that piston rods 31 of the cylinders are directed upward, the piston rods 31 being associated with the duct 19.

Upward movement of the piston rods 31 of the cylinders 24 compresses the resilient seal members 22 and 23 respectively between the above-mentioned flange 30 and the upper flange 20 and between the lower flange 21 and the lower surface on the peripheral edge of the upper-end opening of the enclosure 5.

This causes the resilient sealing members 22 and 23 to maintain the air-tightness of the connections respectively between the sealing chamber 11 of the casting module 3 and the duct 19 and between the duct 19 and the enclosure 5.

In other words, even if the sealing chamber 11, the duct 19 and the enclosure 5 are thermally deformed due to the hot atmosphere in the enclosure 5 under the influence of the hot molten metal pool 13, the inert gas G charged through the conduit 18 into the casting module 3, the enclosure 5 and the scrap box 7 is not allowed to flow outside via the above-mentioned connections.

Downward movement of the piston rods 31 of the cylinders 24 separates the resilient sealing members 22 and 23 away from the flange 30 and from the lower surface on the peripheral edge of the upper-end opening of the enclosure 5, respectively.

In the case of the resilient sealing member 23 being fixed both to the lower flange 21 and to the enclosure 5, downward movement of the piston rods 31 causes the resilient sealing member 23 to expand.

The lower sealing member 26 is formed with the two grooves 25 each of which has an open upper end and circumferentially surrounds the upper end of the scrap box 7.

The sealing material 27 used is amorphous material having fluidity, and may be powder or granule such as sand or liquid such as water.

In the case of the sealing material 27 used being powder or granule such as sand, no wear or wastage occurs due to evaporation at atmosphere temperature outside of the scrap box 7, which can reduce replenishment work of the sealing material 27.

In the case of the sealing material 27 used being liquid such as water, which is superior in fluidity to powder or granule, the grooves 25 may be readily and uniformly replenished with the sealing material 27 on an occasion of the sealing material 27 being reduced in amount due to attachment and detachment of the scrap box 7 to and from the enclosure 5.

The partition plates 28 of the upper sealing member 29 are contiguous with the enclosure 5 and circumferentially and doubly surround the lower end of the enclosure 5 in conformity with the grooves 25.

The partition plates 28 and the grooves 25 are relatively positioned such that the partition plates 28 are fitted into the grooves 25 when the scrap box 7 just below the enclosure 5 is moved upward by the jacks 6 and that the partition plates 28 are separated away from the grooves 25 when the scrap box 7 is lowered by the jacks 6.

As a result, upward movement of the scrap box 7 by the jacks 6 causes lower edges of the partition plates 28 to be penetrated into the sealing material 27 stored in the grooves 25 so that the lower sealing member 26, the sealing material 27 and the upper sealing member 29 maintain the air-tightness of the connection between the scrap box 7 and the enclosure 5.

The lower sealing member 26 with the two grooves 25 and the upper sealing member 29 with the partition plates 28 fittable into the respective grooves 25 provide a multiple air-tightness maintaining boundary, improving the air-tightness of the connection between the scrap box 7 and the enclosure 5.

In other words, even if the enclosure 5, the scrap box 7 and the like are thermally deformed due to high atmosphere temperature within the enclosure 5 under the influence of the hot molten metal pool 13, the inert gas G charged through the conduit 18 to the casting module 3, the enclosure 5 and the scrap box 7 is not allowed to flow outside via the above-mentioned connection.

Thus, in a twin roll casting machine shown in FIGS. 2 and 3, the air-tightness of the connections between the casting module 3 and the duct 19, between the duct 19 and the enclosure 5 and between the enclosure 5 and the scrap box 7 are maintained to restrain the inert gas G from flowing outside, whereby the amount of inert gas G supplied for prevention of the hot strip 2 from oxidization can be reduced.

The invention claimed is:

1. A twin roll casting machine comprising:

a casting module with a pair of chilled rolls adapted to continuously cast a strip;

a duct that has an upper-end opening confronting a lower-end opening of the casting module and through which a strip from the chilled rolls is configured to pass downward;

an enclosure that has an upper-end opening for insertion of a lower portion of the duct and through which the strip having passed via the duct passes toward a succeeding process;

an upper flange contiguous with an upper-end peripheral edge of the duct and extending peripherally;

a lower flange contiguous with a lower-end peripheral edge of the duct, extending peripherally and confronting a lower surface on a peripheral edge of the upper-end opening of the enclosure;

resilient sealing members circumferentially over upper surfaces of the flanges; and pushing means for urging said duct upward.

2. The twin roll casting machine according to claim 1, wherein the resilient sealing members are hollow.

3. A twin roll casting machine comprising:

a casting module with a pair of chilled rolls adapted to continuously cast a strip;

an enclosure with an upper end contiguous with the casting module for passage of the strip from the chilled rolls toward a succeeding process, said enclosure having a lower open end;

a scrap box with an upper-end opening arranged to confront the lower-end opening of the enclosure, said scrap box being vertically movable by a lift;

a lower sealing member arranged circumferentially over an outer side surface of said scrap box and having a circumferentially extending groove;

an amorphous sealing material with fluidity stored in said groove on the lower sealing member; and an upper sealing member arranged circumferentially over an outer periphery of the enclosure and having a partition plate adapted to be fitted into said groove.

4. The twin roll casting machine according to claim 3, wherein the sealing material is powder or granule.

5. The twin roll casting machine according to claim 3, wherein the sealing material is liquid.

6. A twin roll casting machine comprising:

a casting module with a pair of chilled rolls adapted to continuously cast a strip;

an enclosure with an upper end contiguous with the casting module for passage of the strip from the chilled rolls toward a succeeding process, said enclosure having a lower open end;

a scrap box with an upper-end opening arranged to confront the lower-end opening of the enclosure, said scrap box being vertically movable by a lift;

a lower sealing member arranged circumferentially over an outer side surface of said scrap box and having a plurality of circumferentially extending grooves;

an amorphous sealing material with fluidity stored in said grooves on the lower sealing member; and an upper sealing member arranged circumferentially over an outer periphery of the enclosure and having a plurality of partition plates adapted to be fitted into said respective grooves.

7. The twin roll casting machine according to claim 6, wherein the sealing material is powder or granule.

8. The twin roll casting machine according to claim 6, wherein the sealing material is liquid.

* * * * *